United States Patent [19]

Ross

[11] 4,422,489

[45] Dec. 27, 1983

[54] COMBINATION NAIL HOLDER, NAIL SHIELD, AND NAIL FINISHING SET

[76] Inventor: Gary Ross, 2811 Colorado Ave., #3, Santa Monica, Calif. 90404

[21] Appl. No.: 436,015

[22] Filed: Oct. 22, 1982

[51] Int. Cl.[3] ..... B25C 3/00

[52] U.S. Cl. ..... 145/46

[58] Field of Search ..... 145/46

[56] References Cited

U.S. PATENT DOCUMENTS

| | | | |
|---|---|---|---|
| Re. 28,159 | 9/1974 | Litz | 145/46 |
| 3,338,279 | 8/1967 | Kruttschnitt | 145/46 |
| 4,008,741 | 2/1977 | Holstein | 145/46 |

FOREIGN PATENT DOCUMENTS

| | | | |
|---|---|---|---|
| 827926 | 1/1952 | Fed. Rep. of Germany | 145/46 |
| 1159868 | 12/1963 | Fed. Rep. of Germany | 145/46 |
| 2315364 | 1/1977 | France | 145/46 |
| 585964 | 11/1958 | Italy | 145/46 |

*Primary Examiner*—Frederick R. Schmidt
*Assistant Examiner*—J. Zatarga
*Attorney, Agent, or Firm*—Thomas I. Rozsa

[57] ABSTRACT

The present invention relates to a tool which can be used to securely hold a multiplicity of nails for hammering into a vertical wall or against a ceiling in addition to hammering nails downward against a horizontal surface. The same tool can also be effectively used as a shield to protect the surface being hammered against a blow from the hammer if the worker should miss the nail. Additionally, the same tool can be used as a finishing nail set and is useful in this application for both left-handed and right-handed people.

8 Claims, 4 Drawing Figures

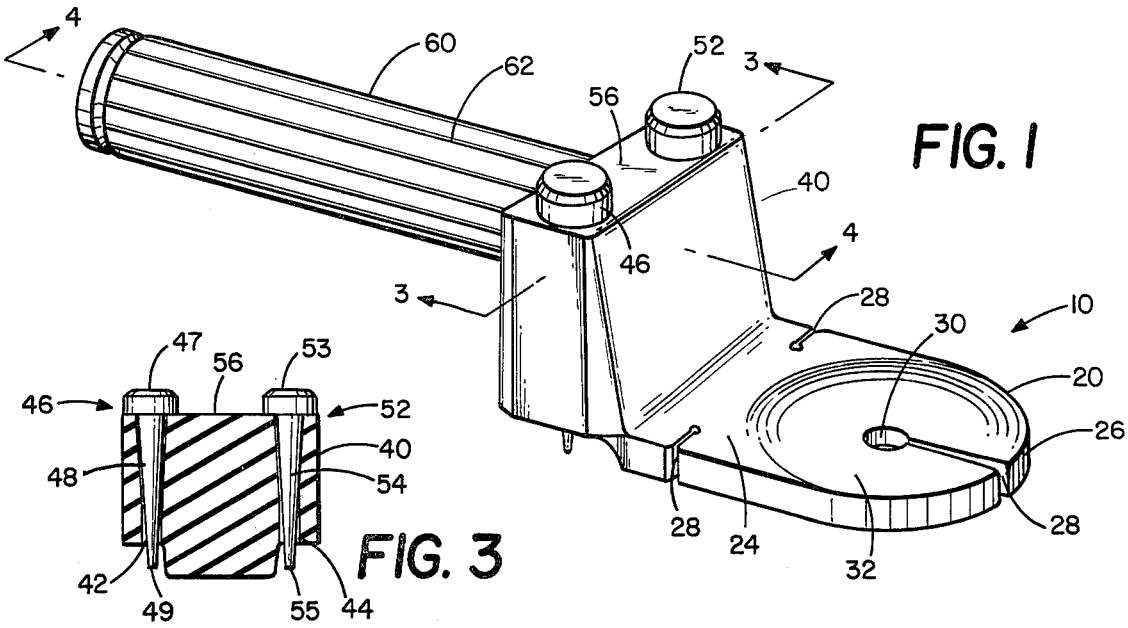
FIG. 1
FIG. 3
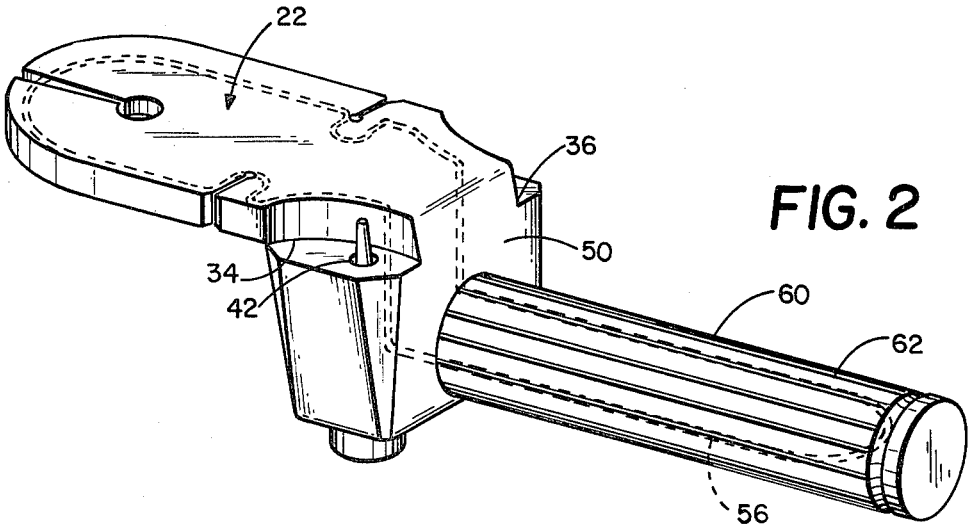
FIG. 2
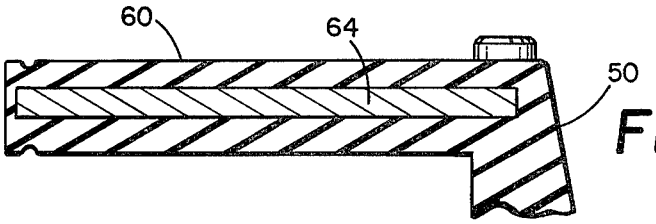
FIG. 4

COMBINATION NAIL HOLDER, NAIL SHIELD, AND NAIL FINISHING SET

BACKGROUND OF THE INVENTION

1. Field of the Invention

The present invention is in the field of construction tool implements. More particularly, the present invention is a tool which is designed to assist a worker in hammering nails into a desired surface area; namely in holding a multiplicity of nails in areas where it is difficult for the worker to effectively hold the nails by hand during the process of hammering the nail into the desired surface such as wood, in acting as a shield so that the hammer will hit the tool instead of the surface such as wood if the worker misses the nail on his strike, and in acting as a finishing nail setter to tap a fine finishing nail slightly below the surface of fine wood.

2. Description of the Prior Art

The prior art contains several patents which disclose tools that are designed to hold a nail or a fastener for hammering into a wooden surface and also are designed to act as a shield to prevent the blow of the hammer accidentally striking the wooden surface if the nail should be missed on a strike. However, all of these prior art designs have several disadvantages and none of them disclose the novel design, application and combination of the present invention.

U.S. Pat. No. 3,682,213 issued to Litz discloses a Nail Placing Implement whose principal function is to assist in the placement of a plurality of nails at desired spaced intervals. The nail holding section is of a sandwich type construction which provides a straight edge that contains a plurality of equally spaced openings for purposes of holding a nail. The design of the tool is of an awkward elongated construction which would make it difficult to use in small, hard to reach areas. The holes through which the nails are placed are of a U-shaped design, from which a nail could easily fall out if the tool was being used to hammer nails into a ceiling or at a substantially elevated area. Since the nails are retained along one lengthwise edge, the tool's use as a shield is at best marginal.

U.S. Pat. No. 4,079,764 issued to Hayes also discloses a Decorative Nail Spacing Tool. Once again, the primary object of this tool is to provide even spacing for hammering in a multiplicity of nails at the same time. The planar surface wherein the nails are held is very small and therefore the effectiveness of the tool as a nail shield is at best marginal. The openings where each nail is held are wide V-shaped grooves. This tool is therefore really only effective for holding the nail while hammering downward on a horizontal surface. The tool could not effectively hold the nails for hammering on a vertical or ceiling surface.

U.S. Pat. No. 3,060,442 issued to Tomek discloses a Nail Holder Tool which is designed to specifically hold a single nail. The tool is very narrow and is totally ineffective for use as a shield. The tool is also capable of holding only one nail at a time.

U.S. Pat. No. 2,716,750 issued to Biblis is applicable for holding a fastener but would be ineffective for holding a nail since the tool is composed of a multiplicity of circular openings which are adequate for generally holding a fastener but are too large and rigid for holding a nail. The tool could not be used to grip a nail when hammering in either a vertical direction or upward against a ceiling.

U.S. Pat. No. 874,613 issued to McColm for a Nail Holder and Set discloses a tool which can carry a multiplicity of nails but again is only effective for hammering downward on a horizontal surface. The tool does not effectively grip the nail for hammering on a vertical surface or on a ceiling surface. The tool is also awkwardly designed and could not be easily fit into inaccessible areas.

Overall, the prior art patents do not disclose a tool which could be effectively used in inaccessible areas while at the same time providing a nail holder that can hold a multiplicity of nails for hammering in a vertical direction against a ceiling or for hammering against a vertical surface and at the same time acting as an effective shield to protect the surface being hammered on. Additionally, none of these patents disclose a tool which can also be used as a finishing nail set to hammer a fine finishing nail slightly below the surface of wood.

SUMMARY OF THE PRESENT INVENTION

The present invention relates to a tool which can be used to securely hold a multiplicity of nails for hammering into a vertical wall or against a ceiling in addition to hammering nails downward against a horizontal surface. The same tool can also be effectively used as a shield to protect the surface being hammered against a blow from the hammer if the worker should miss the nail. Additionally, the same tool can be used as a finishing nail set and is useful in this application for both left-handed and right-handed people.

It has been discovered, according to the present invention, that if a nail holder is made of flexible material which contains a multiplicity of narrow V-grooves along its outer edge, the grooves can effectively hold a nail for hammering purposes in any direction, including a straight vertically upward direction.

It has been further discovered, according to the present invention, that if the narrow grooves extend into an opening well within the inner area of the tool, the tool can be effectively used as a shield to protect the surface while the nail is being hammered into it after the nail has been started into the surface by being held within the narrow V-groove portion of the tool.

It has additionally been discovered, according to the present invention, that if the tool is designed to accommodate a pair of headed metal shafts which each taper to a point at one end, these shafts can be used as a finishing nail set to hammer a fine finishing nail into a wooden surface.

It has also been discovered, according to the present invention, that if the surface which holds the nails is of U-shaped design which then extends into a handle portion that is substantially elevated above the plane of the nail holding portion, the tool can be easily fit into inaccessible areas.

It is therefore an object of the present invention to provide a tool for holding a multiplicity of nails such that the nails can be effectively held regardless of which direction they are being hammered.

It is another object of the present invention to provide a tool which can also be used as an effective nail shield in addition to holding the nail.

It is a further object of the present invention to provide a tool which can also be used as a finishing nail set to hammer in fine finishing nails.

It is an additional object of the present invention to provide a tool which can easily be fit into inaccessible areas while being used to start a nail into the area, then act as a shield to protect the area while the nail is being hammered in, and also occassionally used as a nail set to hammer in finishing nails below the surface.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

FIG. 1 is a perspective view of the present invention looking from the right.

FIG. 2 is a perspective view of the present invention upside down looking from the right, with an optional reinforcing member shown in phantom.

FIG. 3 is a cross-sectional view taken along line 3—3 of FIG. 1.

FIG. 4 is a cross-sectional view taken along line 4—4 of FIG. 1.

DETAILED DESCRIPTION OF THE PREFERRED EMBODIMENT

With reference to the drawings of the invention in detail and more particularly to FIG. 1, there is shown at 10 the preferred embodiment of the Combination Nail Holder, Nail Shield and Nail Finishing Set, hereinafter called the present invention or the tool, interchangeably.

The body of the present invention is made of one piece construction but has three distinct sections; a substantially horizontally disposed planar gripping body member 20, a thick mid-body member 40 located at the rear section of said gripping body 20, and a handle section 60 extending from the rear of the thick mid-body member 40.

In the preferred embodiment, the gripping body 20 is in a substantially U-shaped configuration, as shown in FIGS. 1 and 2, with the curved portion of the U forming the forward edge of the tool 10. Alternatively, the configuration of the gripping body member 10 could be rectangular. The gripping body 20 has a substantially flat lower surface 22 which is placed over the surface of an object into which a nail will be hammered.

The outer edge 26 of the gripping body 20 contains a multiplicity of nail receiving and gripping grooves 28. Each nail receiving and gripping groove 28 is a very narrow V-shaped wedge which extends inward from the edge of the gripping body 20 and also extends through the entire thickness of the gripping body 20. The present invention 10 is made of flexible material such as rubber which therefore permits the very narrow V-shaped groove 28 to receive a significant variety of nails of varying thicknesses and lengths. In the preferred embodiment as shown in FIGS. 1 and 2, there is one larger receiving and gripping groove 28 which extends from the front of the tool inwards and two smaller nail receiving and gripping grooves 28 on either side of the gripping body 20. It is within the spirit and scope of the present invention to have any number of such nail receiving and gripping grooves 28 extending inwardly from various portions of the outer edge of the gripping body 20.

The apex or innermost portion of the nail receiving groove 28 terminates in and extends into an opening 30 which is of generally circular configuration and also extends through the entire thickness of the gripping body 20. In this design, a nail can be held in the nail receiving and gripping groove 28, the lower surface 22 of the gripping body 20 is placed against the surface into which the nail will be hammered, and then the nail is started into the wood or other surface by hammering on it while it is being held in the receiving and gripping groove 28. After it has started into the surface, the nail is slid along the length of the groove 28 until it enters the opening 30. The upper surface 24 of the gripping body 20 contains a recessed area 32 around the opening 30. This serves to provide a target for the worker who can then aim at the nail head and use the recessed area 32 as a guide for accuracy as well as a shield to protect the wood or other surface if the worker should miss the nail on his strike with the hammer. In the preferred embodiment 10 shown in FIGS. 1 and 2, there is only one large opening 30 which extends from the main groove 28 at the front of the tool 10 and the grooves 28 on the sides are merely there to hold additional nails. It is within the spirit and scope of the present invention to have a multiplicity of such large grooves and large openings so that several can be used to act as hammering guides and shields while the nail is hammered into the surface.

The rear portion of the gripping body 20 extends into a thicker upwardly extending mid-body portion 40. The mid-body member 40 extends transversely from the upper surface 24 of the gripping body 20, as more clearly shown in FIG. 2. The portion of the gripping body 20 beneath the mid-body portion 40 is recessed inwards on each side to form right and left cavities 34 and 36 respectively. As shown in greater detail in FIG. 3, the mid-body portion 40 contains two longitudinal substantially cylindrical cavities which extend through the entire height of the mid-body portion 40. Each cylindrical cavity, 42 and 44 respectively, accommodates a headed, sustantially cylindrical tapering shaft 46 and 52 respectively. Cylindrical shaft 46 contains a head portion 47, an elongated tapering body portion 48 and a tip 49. Cylindrical shaft 52 contais a head portion 53, and elongated tapering body portion 54 and a tip 55. Each head, 47 and 53 respectively, rests on the upper surface 56 of the mid-body portion 40. Each shaft portion, 48 and 54 respectively, extends through a respective cavity, 42 and 44. Each tip portion 49 and 55 respectively, protrudes through the bottom of the mid-body portion 40 and into cavities 34 and 36 respectively.

These headed substantially cylindrical tapering shafts 46 and 52 respectively are finishing nail sets which are used to hammer a fine finishing nail slightly below the surface of fine wood. A finishing nail is started in the receiving and gripping groove 28, is hammered into the wood by being slid into the opening 30 and hammered most of the way in, and then the tool 10 is removed and the tip 49 or 55 of shaft 46 or 52 is placed over the nail and the hammer is used to tap the head portion, 47 or 53 to gently tap the finishing nail slightly below the surface of the wood. The purpose of two such shafts is to accommodate a left-handed or a right-handed user or to accommodate a particular application if only one of the areas of the tool 10 is accessible to such hammering. Each shaft 46 and 52 is made of metal such as steel.

The third section of the tool 10 is the handle 60 which extends substantially perpendicular to the rear surface 50 of the mid-body portion 40. For ease of gripping, the handle 60 is substantially cylindrical and has a slightly textured surface 62. Other shapes for the handle 60 are also within the spirit and scope of the present invention. Since the entire tool 10 is formed out of flexible material such as rubber, it is preferable to have a reinforcing member in the handle 60 to stiffen it and make the tool 10 easier to grip. A reinforcing member 64 such as a wooden dowel or metal rod is therefore cast into the handle section 60, as shown in FIG. 4.

In some applications, it may be desirable to also stiffen the gripping body 20 as well as the rest of the tool 10. In such an alternative embodiment, a reinforcing member 56 can be cast into the tool 10 as shown in phantom in FIG. 2, such that the reinforcing member 56 extends within the body of the tool 10 and adjacent the outer edge of each section, and goes around and does not interfere with any groove 28 or hole 30 or cylindrical opening 46 or 52.

The present invention 10 therefore provides a very useful combination nail holder, nail shield and nail finishing set, all in one compact design. Since the tool 10 is made of flexible material such as rubber, it can very easily be fit into difficult to reach areas. The design of the very narrow V-grooves 28 into flexible and resilient material such as rubber permits the worker to use the tool 10 to hold any multiplicity of sizes of nails in any desired direction whatsoever, including holding nails for hammering against a vertical wall or hammering straight upward against a ceiling. The compact design of having left and right nail sets permits the worker to use the tool to also hold and start fine finishing nails, hammer them well into the fine wood, and then tap them in with the finishing set. The left and right nail sets makes the tool useful for either left-handed or right-handed workers. The multiplicty of receiving and gripping grooves 28 enable a worker to grip several nails at the same time so the worker can hammer in one after the other. This is especially useful when the worker is working in an area where accessibility is difficult.

The tool 10 can be of any variety of sizes, and is not confined to one set of dimensions. In one example, a common construction wood is a 2×4, which is in fact $1\frac{5}{8}$ inches high and $3\frac{1}{2}$ inches wide. The present invention can be designed such that the gripping body 20 is $1\frac{5}{8}$ inches wide and $3\frac{1}{2}$ inches long from front to back. This allows it to fit perfectly either over the height or the width of a 2×4 to thereby completely shield the wood while the worker is hammering the nail in. By using a tool 10 of these dimensions, the tool 10 can also be used as a measuring device to indicate how many 2×4s will fit in a given area. The lengths of $3\frac{1}{2}$ inches can be used to measure the number of widths of 2×4s which can be accommodated in a given area. The widths of $1\frac{5}{8}$ inches can be used to measure the number of heights of 2×4s which can be accommodated in a given area. To complete the sample specification, the height of the mid-body member 40 can be $1\frac{1}{2}$ inches and the handle 60 can be 1 inch in diameter and 4 inches long. With these dimensions, the tool 10 can easily be fit into the tool pouch or nail bag or a construction worker.

The tool 10 can be molded out of rubber or other comparable flexible and resilient material. The tool can further have the stiffening members previously described cast into the rubber, either in just the handle member or throughout the tool as previously described.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment, not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of the patent monopoly to be granted.

What is claimed is:

1. A combination tool comprising:

a. a gripping body member formed in a substantially U-shaped configuration with the curved portion of the U forming the forward edge of the tool;

b. a multiplicity of very narrow V-shaped grooves, each of which extends inwardly from the outer edge of the gripping body member and each of which extends through the entire thickness of the gripping body member;

c. the apex of one or more of said very narrow V-shaped grooves terminating in and extending into an opening within the interior of said gripping body member;

d. each of said interior openings associated with a very narrow V-shaped groove also extending through the entire thickness of said gripping body member;

e. a mid-body member located at the rear of said gripping body member and extending transversely from the upper surface of said gripping body member such that cavities are formed on either side of the rear portion of the gripping body member and beneath the mid-body member;

f. a pair of substantially cylindrical openings extending through the entire height of said mid-body member;

g. a pair of headed substantially cylindrical tapering shafts, one of which is received within each of said substantially cylindrical openings in said mid-body member such that the head of each shaft rests on the upper surface of said mid-body member and the tip of each shaft protrudes through the lower surface of said mid-body member and into the cavity on either side of the rear portion of said gripping body member and below said mid-body member; and h. a handle extending from the rear surface of said mid-body member;

i. whereby each very narrow V-shaped groove can be used to hold a nail in any desired direction while it is hammered into a surface of an object, the combination tool can act as a shield to protect the surface during the hammering process, and either of the substantially cylindrical tapering shafts can be used as a nail set to hammer the nail slightly below the surface of the object.

2. The invention as defined in claim 1 wherein the combination tool is made of one piece construction from flexible and resilient material such as rubber.

3. The invention as defined in claim 1 wherein said substantially cylindrical tapering shafts are made of metal.

4. The invention as defined in claim 1 wherein said gripping body member is formed in a substantially rectangular configuration.

5. The invention as defined in claim 1 wherein said handle is cylindrical and extends from the rear portion of said mid-body member in a direction substantially parallel to said gripping body member.

6. The invention as defined in claim 1 wherein the combination tool is made of flexible and resilient material and a reinforcing member is cast into the tool to stiffen the gripping body member, the mid-body member and the handle.

7. The invention as defined in claim 1 wherein the combination tool is made of flexible and resilient material and a reinforcing member is cast into the handle to stiffen it.

8. The invention as defined in claim 1 wherein the upper surface of said gripping body member further contains a recessed area surrounding each of said interior openings.

* * * * *